US007592892B2

(12) United States Patent
Ito et al.

(10) Patent No.: US 7,592,892 B2
(45) Date of Patent: Sep. 22, 2009

(54) FUSIBLE LINK UNIT ACCOMMODATED IN IN-VEHICLE ELECTRICAL CONNECTION BOX

(75) Inventors: Katsuya Ito, Mie (JP); Akira Hirata, Chiryu (JP); Manabu Ohta, Gifu (JP)

(73) Assignees: Sumitomo Wiring Systems, Ltd., Mie (JP); Pacific Engineering Corp., Ogaki (JP)

( * ) Notice: Subject to any disclaimer, the term of this patent is extended or adjusted under 35 U.S.C. 154(b) by 256 days.

(21) Appl. No.: 11/729,821

(22) Filed: Mar. 30, 2007

(65) Prior Publication Data

US 2007/0241857 A1 Oct. 18, 2007

(30) Foreign Application Priority Data

Apr. 18, 2006 (JP) ..... 2006-114078

(51) Int. Cl.
*H01H 85/08* (2006.01)
*H01H 85/165* (2006.01)

(52) U.S. Cl. ..... 337/159; 337/187; 337/186

(58) Field of Classification Search ..... 337/187, 337/186, 159

See application file for complete search history.

(56) References Cited

U.S. PATENT DOCUMENTS 2,068,584 A * 1/1937 Wood ..... 337/265
2,737,552 A * 3/1956 Hitchcock ..... 337/229
5,088,940 A * 2/1992 Saito ..... 439/620.34
5,643,693 A * 7/1997 Hill et al. ..... 429/121
5,795,193 A * 8/1998 Yang ..... 439/620.27
5,886,611 A * 3/1999 Schaller et al. ..... 337/189
6,294,978 B1 * 9/2001 Endo et al. ..... 337/166
6,476,705 B1 * 11/2002 Betti et al. ..... 337/161
6,509,824 B2 * 1/2003 Inaba et al. ..... 337/295
6,512,443 B1 * 1/2003 Matsumura et al. ..... 337/189
6,624,356 B2 9/2003 Sumida et al.
6,759,938 B2 * 7/2004 Matsumura et al. ..... 337/161
6,824,430 B2 * 11/2004 Matsumura et al. .... 439/620.29
6,830,482 B2 * 12/2004 Matsumura et al. .... 439/620.27
7,071,808 B2 7/2006 Nakamura
7,176,780 B2 * 2/2007 Iwata ..... 337/188
7,321,286 B2 * 1/2008 Nojima et al. ..... 337/189
7,420,453 B2 * 9/2008 Matsumura et al. ..... 337/295

FOREIGN PATENT DOCUMENTS

EP 1075012 A2 * 2/2001
JP A 2001-256878 9/2001

* cited by examiner

*Primary Examiner*—Anatoly Vortman
(74) *Attorney, Agent, or Firm*—Oliff & Berridge, PLC

(57) ABSTRACT

A fusible link unit includes a bus bar adapted to be connected to a battery without interposing a fuse between the bus bar and the battery, and a heat resistant insulating sheet which covers at least an upper edge portion of the bus bar. The fusible link unit is adapted to be accommodated inside an in-vehicle electrical connection box.

13 Claims, 5 Drawing Sheets

FUSIBLE LINK UNIT ACCOMMODATED IN IN-VEHICLE ELECTRICAL CONNECTION BOX

The present invention claims priority from Japanese Patent Application No. 2006-114078 filed on Apr. 18, 2006, the entire content of which is incorporated herein by reference.

BACKGROUND OF INVENTION

1. Field of the Invention

The present invention relates to a fusible link unit adapted to be accommodated in an in-vehicle electrical connection box. More specifically, the present invention relates to a fusible link unit including a bus bar, the bus bar forming a raw power supply circuit to be connected to a battery. The present invention provides a safety measure for such a bus bar.

2. Description of the Related Art

Bus bars are generally accommodated inside a case of an in-vehicle electrical connection box. Each of the bus bars is formed into a required shape by blanking a conductive metal sheet, thereby, serving as an internal circuit.

Among the bus bars, there is a bus bar which is connected to a battery without interposing a fuse therebetween. In other words, such a bus bar is connected to a raw power supply circuit. Since a high current of 100 amperes or more flows through such a bus bar, in the event that a tool or the like erroneously falls when installing the electrical connection box to the vehicle and a cover or an upper wall of a housing accommodating the bus bar therein is damaged, the bus bar may become exposed, whereby a short circuit may occur.

For example, as shown in FIGS. 6A and 6B, a bus bar 5 to be connected to a raw power supply circuit includes a fusible link and is accommodated in a fuse box 1 arranged on a side surface of a battery, and an upper cover 6 is placed thereover (see, e.g., JP-A-2001-256878).

The bas bar 5 is formed such that a primary bus bar portion 2, a secondary bus bar portion 3 and a fuse element 4 are formed in a one-piece structure, and battery attaching portions 2*a* of the bas bar 5 are directly attached to the battery. The battery attaching portions 2*a* are accommodated in the fuse box 1 without being molded.

With the fuse box 1 that is configured as described above, in the event that a tool or the like falls on the cover 6 and breaks the same when installing the fuse box 1 on a vehicle, the battery attaching portions 2*a* of the bus bar 5 may become exposed, whereby a short circuit or an electric leak may occur.

SUMMARY OF INVENTION

The present invention has been made in view of the above described problems, and it is an object thereof to provide a safe and secure fusible link unit in which an electric leak or a short circuit can be prevented even when the bus bar including a fusible link becomes exposed.

According to an aspect of the invention, a fusible link unit includes a bus bar adapted to be connected to a battery without interposing a fuse between the bus bar and the battery, and a heat resistant insulating sheet which covers at least an upper edge portion of the bus bar. The fusible link unit is adapted to be accommodated inside an in-vehicle electrical connection box.

DETAILED DESCRIPTION

Hereinafter, an exemplary embodiment of the invention will be described with reference to the drawings. The following exemplary embodiment does not limit the scope of the invention.

Figure 1:
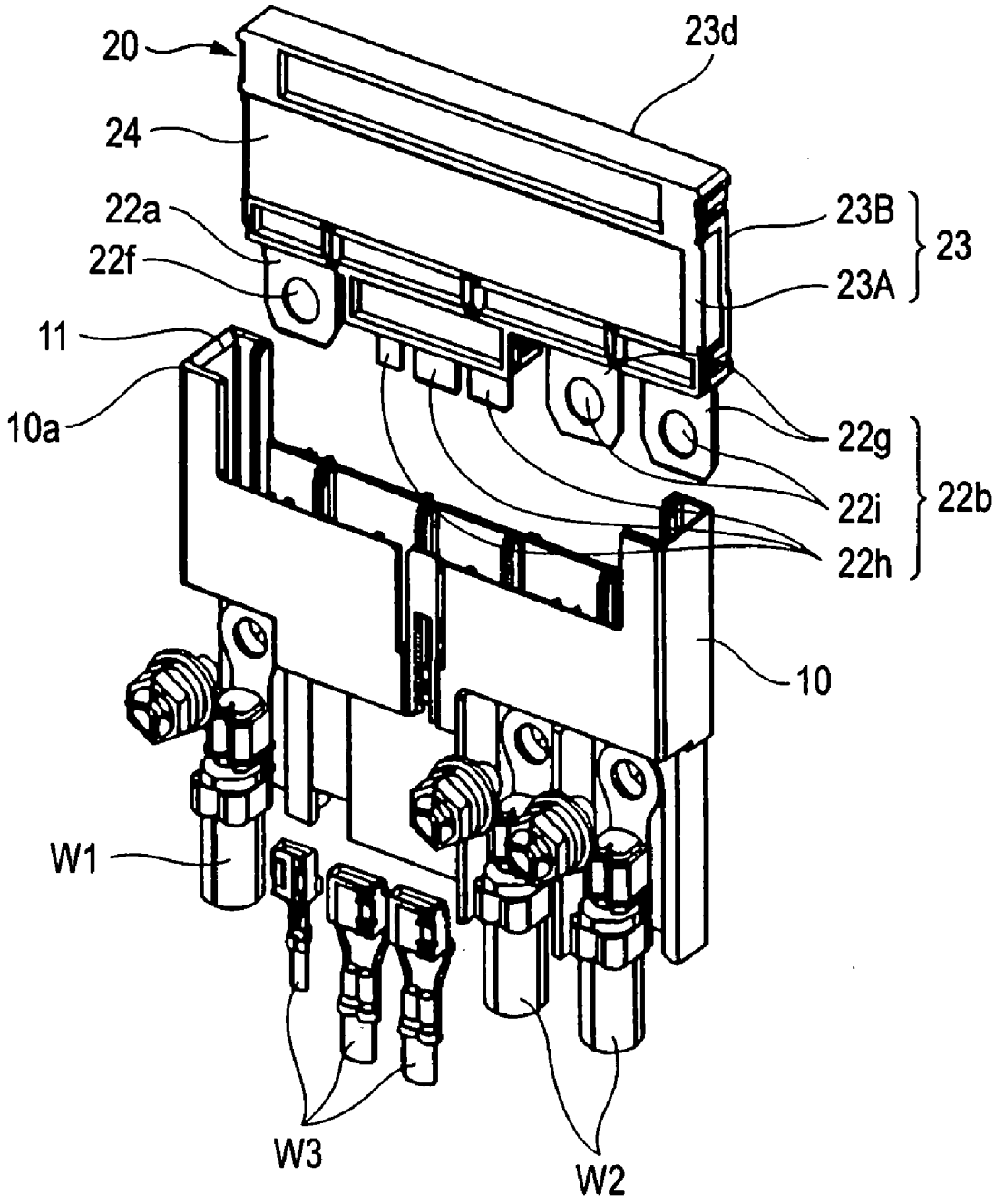
FIG. 1 is a perspective view showing a case and a fusible link unit according to an exemplary embodiment of the invention.

FIG. 1 shows a case 10 of a fuse box which is installed close to a battery (not shown) on a vehicle.

Figure 2:
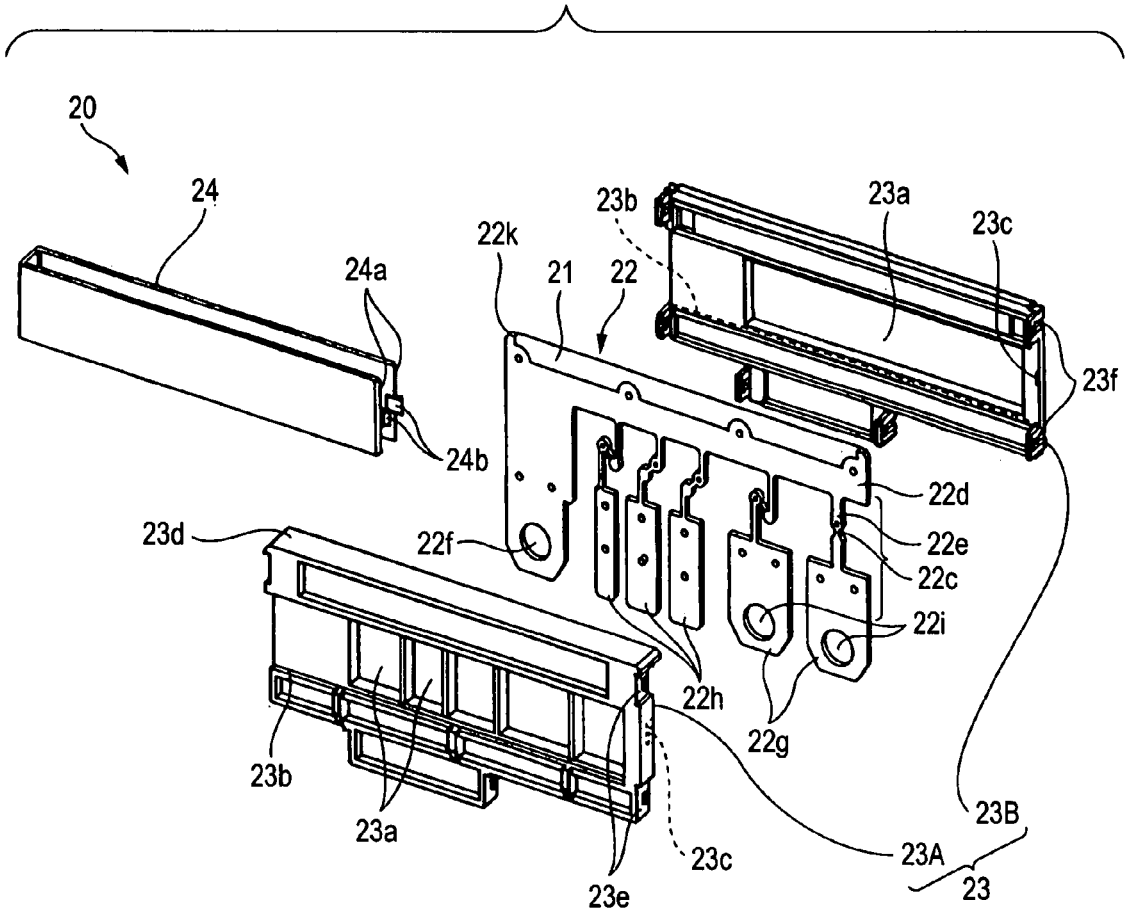
FIG. 2 is an exploded perspective view showing the fusible link unit shown FIG. 1.

The case 10 has an accommodating portion 11 in which a fusible link unit 20 shown in FIG. 2 is accommodated. In the fusible link unit 20, a bus bar 22 including a fusible link is accommodated in a housing 23.

The fusible link unit 20 is positioned on a side of an upper end 10*a* of the case 10, and is accommodated in the accommodating portion 11 in such a manner that an upper portion of the housing 23 projects from the upper end 10*a* of the case 10.

As shown in FIG. 2, the fusible link unit 20 includes a bus bar 22 covered by a heat resistant insulating sheet 21, the housing 23 which is made of a resin and accommodates the bus bar 22, and a cover 24 which is slidably attached to the housing 23. The bus bar 22 includes vertical bus bars which are vertically disposed inside the housing 23, and the vertical bus bars form a raw power supply circuit which is directly connected to the battery without interposing a fuse therebetween.

Figure 3:
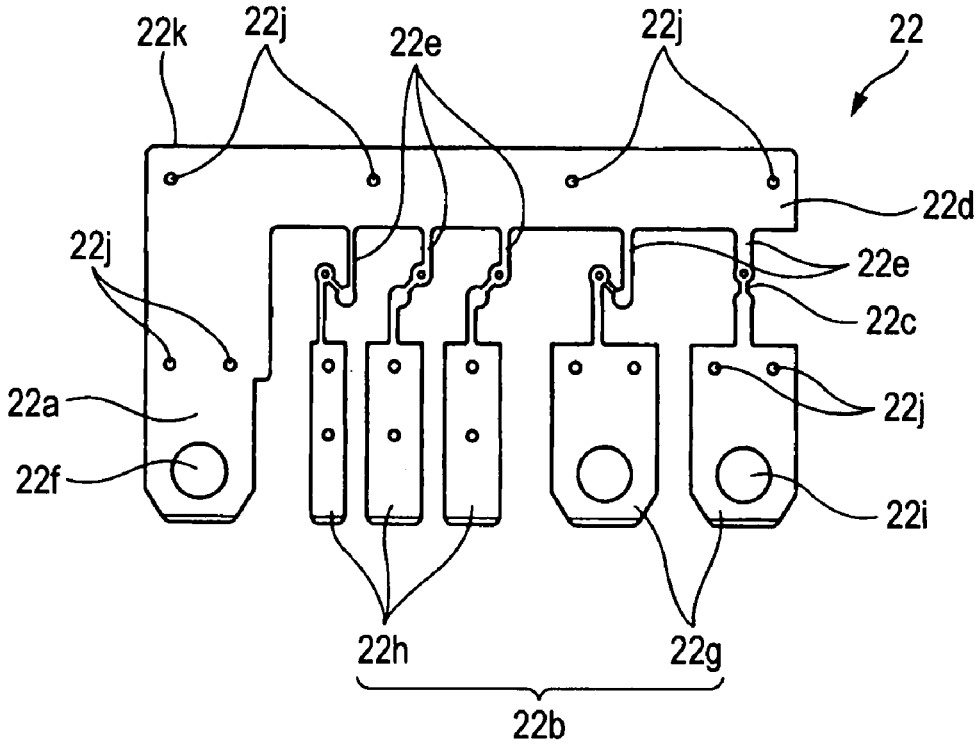
FIG. 3 is a front view of a bus bar according to the exemplary embodiment.

As shown in FIG. 3, the bus bar 22 is formed by blanking a conductive metal sheet, and includes a plurality of fusible portions 22*c*, each formed as an S-shaped narrow portion.

More specifically, the bus bar 22 includes an input terminal portion 22*a* which is disposed at one end thereof for a connection to the battery, a common circuit portion 22*d* which is continuously connected to the input terminal portion 22*a*, and a plurality of branch circuit portions 22*e* which is disposed in such a manner as to be branched from the common circuit portion 22*d*. Each of the branch circuit portions 22*e* includes the narrow fusible portion 22*c* and an output terminal portion 22*b* disposed at a distal end portion of the branch circuit portion 22*e* on a downstream side of the fusible portion 22*c*.

As shown in FIGS. 1 and 3, a bolt hole 22*f* is formed on the input terminal portion 22*a*, so that the input terminal portion 22*a* is connected to a terminal W1 of an electric wire by tightening a bolt through the hole 22*f*. The terminal W1 is connected to the battery. The output terminal portions 22*b* includes a large current output terminal portions 22*g* and a small current output terminal portions 22*h*. A bolt hole 22*i* is formed on each of the large current output terminal portions 22*g*, so that the large current output terminal portions 22*g* are connected to respective terminal W2 of electric wires by tightening a bolt through each of the bolt hole 22*i*. The terminals W2 are connected to an electric component such as an alternator or a generator which requires a large current. The small current output terminals 22*h* are connected to a terminal W3 of electric wires which are connected to other electric components. Boss holes 22*j* are formed on the bus bar 22 at predetermined positions, whereby the bus bar 22 is positioned when being accommodated in the housing 23.

The bus bar is accommodated in a vertical direction inside the housing 23, and a thin upper edge portion 22*k* of the common circuit portion 22*d* is positioned in such a manner as to face an inner surface of an upper end wall 23*d* of the housing 23. The upper edge portion 22*k* of the common circuit portion 22 is covered by the heat resistant insulating sheet 21 such that the heat resistant insulating sheet 21 straddles the upper edge portion 22*k*.

When the bus bar 22 is covered by the heat resistant insulating sheet 21 in this way, the heat resistant insulating sheet 21 does not fall off from the surface of the bus bar 22 even when an impact is applied thereto from outside (e.g., a vibration of the vehicle or a collision of a tool), whereby the bus bar 22 can be reliably protected. Moreover, the portion that is to be covered by the heat resistant insulating sheet 21 can be minimum, thereby keeping heat releasing property of the bus bar 22.

The heat resistant insulating sheet 21 may be formed from a fluorine plastic sheet having a heat-resisting property and an electrically insulating property. In such a case, an adhesive agent is coated on an inner surface of the fluorine plastic sheet, whereby the fluorine plastic sheet is adhered to a surface of the bus bar 22 via the adhesive agent.

The fluorine plastic sheet has superior heat resistance so that it neither deforms nor melts even when the temperature inside the case 10 increases. In addition, the fluorine plastic sheet is excellent in an electrical insulation. Therefore, the an electric leak and a short circuit of a current flowing through the bus bar 22 can be reliably prevented from occurring.

Figure 4:
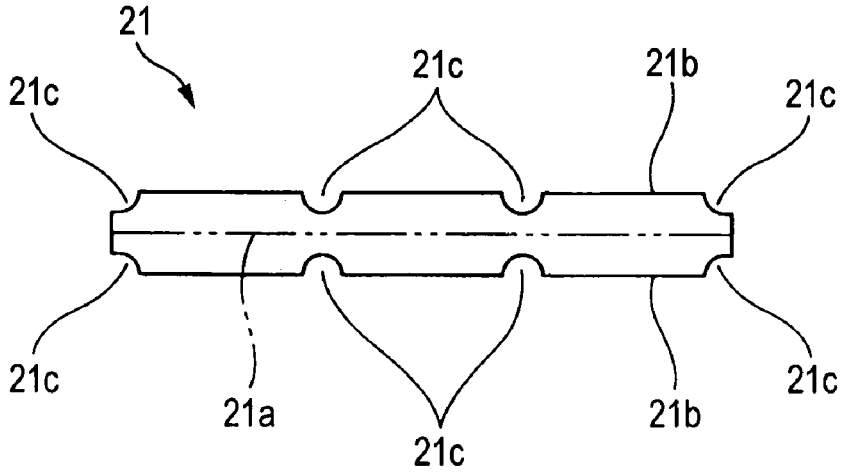
FIG. 4 is a plan view of a heat resistant insulating sheet.

As shown in FIG. 4, the heat resistant insulating sheet 21 is formed substantially into a tape shape which is vertically symmetrical across a center line 21*a*. A length of the heat resistant insulating sheet 21 along a longer side thereof is slightly shorter than a length of the common circuit portion 22*d* of the bus bar 22 along a longer side thereof. A length of the heat resistant insulating sheet 21 along a shorter side thereof is such that respective side edges 21*b* on the longer side reach the boss holes 22*j* when the heat resistant insulating sheet 21 straddles the upper edge portion 22*k* of the bus bar 22 and is folded along the center line 21*a* into two halves.

A plurality of concave portions 21*c* is formed along the respective side edges 21*b* by cutting out the portions which faces the boss hole 22*j* of the common circuit portion 22*d*.

Figure 5A:
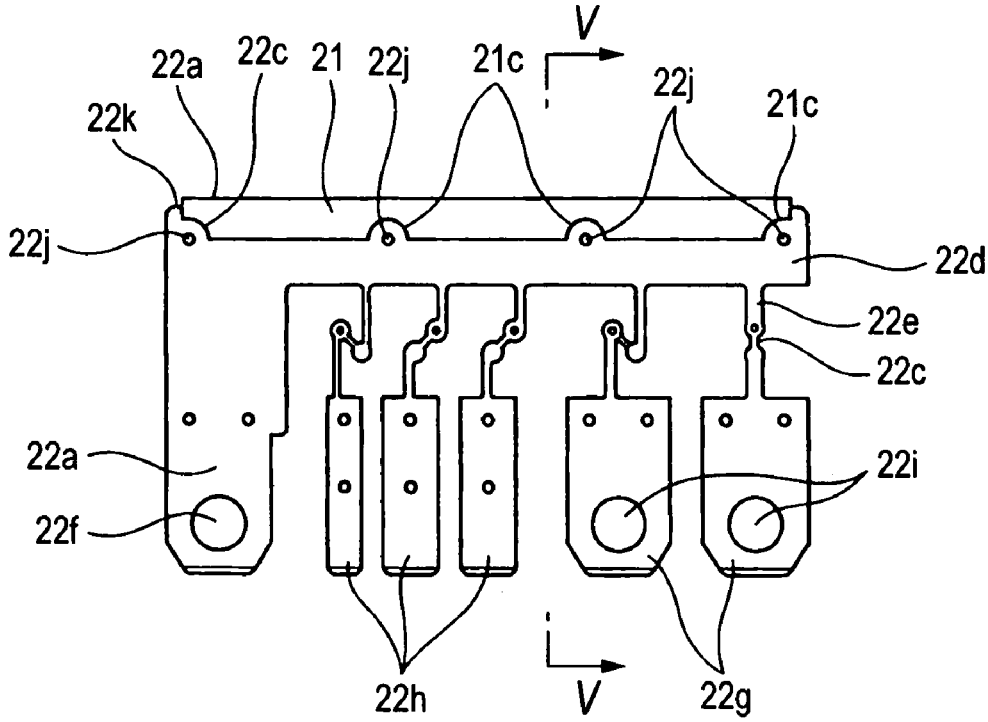
FIG. 5A is a front view of the bus bar covered by the heat resistant insulating sheet.
Figure 5B:
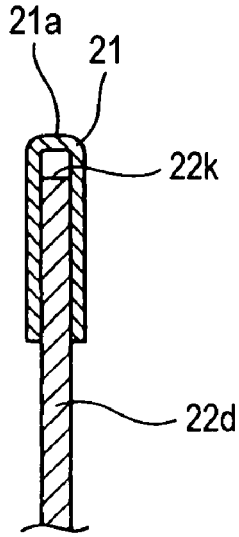
FIG. 5B is a sectional view taken along the line V-V in FIG. 5A.
Figure 6A:
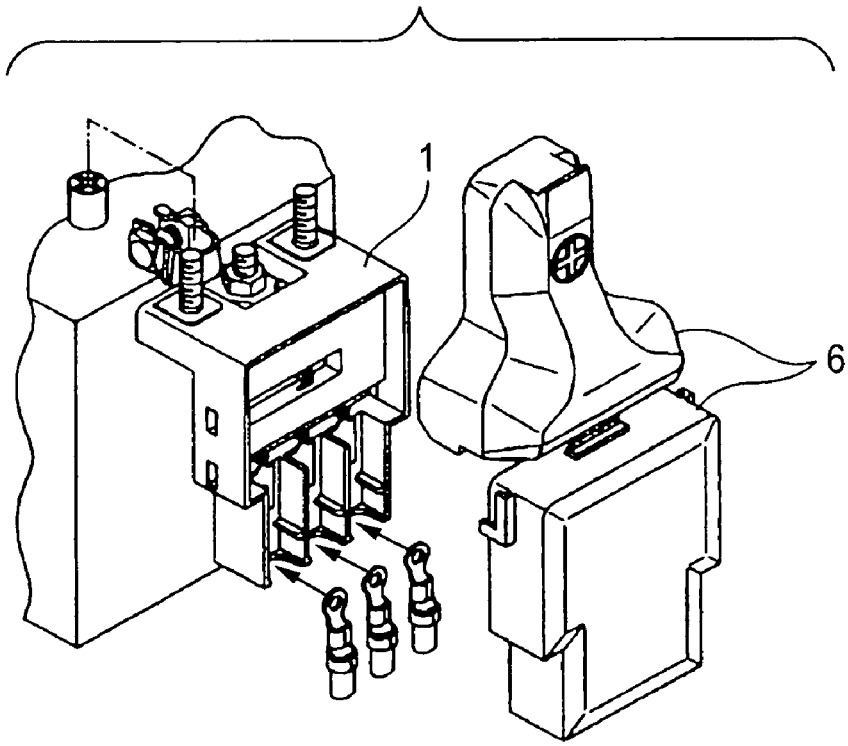
FIG. 6A RELATED ART
FIGS. 6A and 6B show an example of a related art.
Figure 6B:
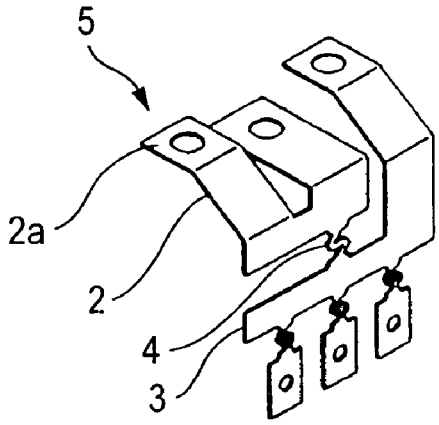
FIG. 6B RELATED ART

As shown in FIGS. 5A and 5B, the heat resistant insulating sheet 21 is folded along the center line 21*a* thereof into two halves, and the concave portions 21*c* of the heat resistant insulating sheet 21 are aligned at the positions where the boss holes 22*j* are in the bus bar 22, and then the heat resistant insulating sheet 21 is brought to straddle the upper edge portion 22*k* of the bus bar 22, thereby covering both side surfaces of the upper edge portion 22*k*.

The housing 23 for accommodating the bus bar 22 is made of a glass containing material in order to enhance heat resistance and strength thereof.

As shown in FIG. 2, the housing 23 includes a primary housing portion 23A and a secondary housing portion 23B. The primary housing portion 23A and the secondary housing portion 23B are formed with window openings 23*a* at positions facing the fusible portions 22*c* of the bus bar 22, so that a fusing state of the fusible portions 22*c* can be visually checked from an exterior through the window openings 23*a*.

In addition, a sliding cover attaching portion 23*b* is formed along a center portion of an external surface of each of the primary housing portion 23A and the secondary housing portion 23B, while a engaging hole 23*c* is provided on one end of an internal surface of each of the primary housing portion 23A and the secondary housing portion 23B. The upper end wall 23*d* having a shape like a pentroof is formed at an upper end portion of the primary housing portion 23A.

A plurality of locking grooves 23*e* is formed on a side edge of the primary housing portion 23A, while locking pieces 23*f* are formed on the secondary housing portion 23B at positions facing the locking grooves 23*e* of the primary housing portion 23A. The locking grooves 23*e* of the primary housing portion 23A and the locking pieces 23*f* of the secondary housing portion 23B joins together and locks, interposing the bus bar 22 therebetween.

The cover 24 which is attached to the housing 23 is made of a transparent resin and is formed into a shape having a substantially U-shaped cross section by bending a resin plate. A pair of engaging pieces 24*b* is provided on respective end portions 24*a* of the cover 24 on a side to be inserted in the housing 23, and the pair of engaging pieces 24*b* engage with the respective engaging holes 23*c* of the housing 23.

The bus bar 22 covered by the heat resistant insulating sheet 21 is held between the primary housing portion 23A and the secondary housing portion 23B in such a state that the bus bar 22 is positioned at the boss holes 22*j*, and the locking grooves 23*e* of the primary housing portion 23A and the locking pieces 23*f* of the secondary housing portion 23B are joined together in a locked fashion, whereby the bus bar 22 is accommodated in the housing 23. When the bus bar 22 is accommodated in the housing 23, the upper edge portion 22*k* of the common circuit portion 22*d* of the bus bar 22 is disposed to face the inner surface of the upper end wall 23*d* of the primary housing portion 23A.

The cover 24 is slid along the longer side direction of the housing 23 from a side of the input terminal portion 22*a* of the bus bar 22 so as to be inserted into the cover attaching portions 23*b* of the housing 23 inside which the bus bar 22 is accommodated, and the engaging pieces 24*b* provided on the cover 24 then engages with the engaging holes 23*c* provided on an inner side of the housing 23.

According to the above configuration, the bus bar 22 that is directly connected to the battery from which a high current flows is accommodated inside the housing 23 which is made of a material containing glass. Therefore, the housing 23 likely to be broken when receiving an impact from a tool or other members. Further, it is the upper end wall 23*d* of the housing 23 where it is more likely to be broken when the tool falls thereon while installing an electrical connection box on a vehicle.

However, according to the above exemplary embodiment, the bus bar 22 is covered by the heat resistant insulating sheet 21 on a portion where it faces the upper end wall 23*d* of the housing 23. Therefore, the safety can be secured even when an unexpected event occurs.

More specifically, even when the upper cover of the fuse box as well as the upper end wall 23*d* of the primary housing portion 23A are broken by a tool falling thereon and the bus bar 22 becomes exposed, since the heat resistant insulating sheet 21 covers the upper edge portion 22*k* of the bus bar 22 facing the upper end wall 23*d* of the primary housing portion 23A, a metallic portion of the bas bur 22 forming a raw power supply circuit does not becomes exposed, whereby a short circuit and an electric leak can be prevented from occurring so that the safety of the bus bar 22 is enhanced.

If the whole surface of the bus bar 22 is covered by the heat resistant insulating sheet 21, the heat releasing property of the bus bar 22 decreases. Therefore, at least the upper edge portion 22*k* of the bus bar 22 where it is likely to be exposed is covered by the heat resistant insulating sheet 21, thereby satisfying both the heat releasing property and the safety of the bus bar 22.

The heat resistant insulating sheet 21 that covers the bus bar 22 is inexpensive. Therefore, the production cost can be suppressed. Furthermore, since the heat resistant insulating sheet 21 only has to be affixed to the bus bar 22, little working time is required, thereby resulting in good workability.

While description has been made in connection with an exemplary embodiment of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A fusible link unit adapted to be accommodated inside an in-vehicle electrical connection box, comprising:

a bus bar adapted to be connected to a battery without interposing a fuse between the bus bar and the battery; and a heat resistant insulating sheet which covers at least an upper edge portion of the bus bar, wherein the heat resistant insulating sheet is folded so as to straddle the upper edge portion of the bus bar.

2. The fusible link unit according to claim 1, further comprising a housing which accommodates at least a part of the bus bar therein, wherein an upper end wall of the housing faces the heat resistant insulating sheet.

3. The fusible link unit according to claim 2, wherein the bus bar is accommodated in a vertical direction inside the housing.

4. The fusible link unit according to claim 1 wherein the heat resistant insulating sheet is folded into two halves.

5. The fusible link unit according to claim 1, wherein the bus bar comprises:

an input terminal portion adapted to be connected to the battery;

a common circuit portion which is continuously connected to the input terminal portion; and a plurality of branch circuit portions which are branched from the common circuit portion, each of the branch circuits including a fusible portion and an output terminal portion disposed on a downstream side of the fusible portion, wherein the fusible portion is narrower than the output terminal portion, and the upper edge portion of the bus bar includes an upper edge of the common circuit portion.

6. The fusible link unit according to claim 1, wherein the heat resistant insulating sheet includes a fluorine plastic sheet.

7. The fusible link unit according to claim 6, wherein the heat resistant insulating sheet further includes an adhesive agent coated on a surface of the fluorine plastic sheet.

8. The fusible link unit according to claim 2, wherein a boss hole is formed on the bus bar to position the bus bar with respect to the housing, and a concave portion is formed on the heat resistant insulating sheet by cutting out a portion which faces the boss hole.

9. The fusible link unit according to claim 2, wherein the housing is made of a glass containing material.

10. The fusible link unit according to claim 2, wherein the housing includes a primary housing portion and a secondary housing portion, wherein the bus bar is held between the primary housing portion and the secondary housing portion.

11. The fusible link unit according to claim 2, wherein an opening is formed on the housing such that an fusible portion of the bus bar can be visually checked through the opening.

12. The fusible link unit according to claim 11, further comprising a cover which is slidably inserted into the housing, wherein the cover is transparent.

13. The fusible link unit according to claim 1, wherein the heat resistant insulating sheet is directly attached to the upper edge portion of the bus bar.

* * * * *